US005273412A

United States Patent [19]

Zwaans

[11] Patent Number: 5,273,412

[45] Date of Patent: Dec. 28, 1993

[54] LUBRICATED ROTARY COMPRESSOR HAVING A COOLING MEDIUM INLET TO THE DELIVERY PORT

[75] Inventor: Marianus H. J. M. Zwaans, Deest, Netherlands

[73] Assignee: Grasso's Koninklijke Machinefabrieken N.V., 'S Hertogenbosch, Netherlands

[21] Appl. No.: 57,411

[22] Filed: May 6, 1993

Related U.S. Application Data

[63] Continuation of Ser. No. 853,801, Mar. 19, 1992, abandoned.

[30] Foreign Application Priority Data

Mar. 28, 1991 [NL] Netherlands ..... 9100555

[51] Int. Cl.[5] ..... F04C 18/16; F04C 29/02; F04C 29/04; F25B 31/00

[52] U.S. Cl. ..... 418/97; 418/201.1; 62/505

[58] Field of Search ..... 418/83, 97-100, 418/201.1; 62/505

[56] References Cited

U.S. PATENT DOCUMENTS

| | | | |
|---|---|---|---|
| 1,675,524 | 7/1928 | Zajac . | |
| 1,890,205 | 12/1932 | Andresen . | |
| 1,932,607 | 10/1933 | Smith . | |
| 2,489,887 | 11/1949 | Houghton . | |
| 3,138,320 | 6/1964 | Schibbye | 418/99 |
| 5,131,817 | 7/1992 | Pastore, Jr. | 418/97 |

FOREIGN PATENT DOCUMENTS

| | | | |
|---|---|---|---|
| 2044388 | 2/1972 | Fed. Rep. of Germany . | |
| 2119558 | 9/1983 | Fed. Rep. of Germany . | |
| 58-183888 | 10/1983 | Japan | 418/201.1 |
| 502690 | 3/1939 | United Kingdom . | |
| 1352699 | 5/1974 | United Kingdom | 418/97 |
| 1512507 | 6/1978 | United Kingdom . | |
| 1570973 | 7/1980 | United Kingdom . | |

*Primary Examiner*—John J. Vrablik
*Attorney, Agent, or Firm*—Young & Thompson

[57] ABSTRACT

A rotary compressor such as a screw-type or a spiral compressor comprises a compressor stator and one or more rotary compression elements, which compressor stator is provided with a suction port, a delivery port and a lubricant inlet, the lubricant being intended for lubricating each compression element, for sealing the gaps between the individual compression elements and between the compression elements and the compressor stator, and for cooling the medium to be compressed during the compression process. The compressor also comprises an inlet for a cooling medium for cooling the lubricant which opens out near or in the delivery port.

5 Claims, 2 Drawing Sheets

LUBRICATED ROTARY COMPRESSOR HAVING A COOLING MEDIUM INLET TO THE DELIVERY PORT

This application is a continuation of application Ser. No. 07/853,801, filed Mar. 19, 1992, now abandoned.

FIELD OF THE INVENTION

The invention relates to a rotary compressor such as a screw-type or a spiral compressor, comprising a compressor stator and one or more rotary compression elements, which compressor stator is provided with a suction port, a delivery port and a lubricant inlet, the lubricant being intended for lubricating each compression element, for sealing the gaps between the individual compression elements and between the compression elements and the compressor stator, and for cooling the medium to be compressed during the compression process, and also comprising a device for cooling the lubricant by injecting a cooling medium.

BACKGROUND OF THE INVENTION

Such a rotary compressor is known from German Patent 2,261,336. In this case the lubricant, which is discharged from the compressor together with the compressed medium, is cooled by injecting a cooling medium. Due to the fact that this cooling medium evaporates in the space in which the mixture is compressed, the temperature of said mixture falls, which means that the oil temperature also falls.

This known method of cooling has the disadvantage that cooling medium in liquid form leaks through the gaps to be sealed with lubricant, as a result of which loss of output occurs. A second disadvantage is that the cooling medium disrupts the lubrication of the compression elements during the compression process, which reduces the operating reliability of the compressor.

In the absence of a device for cooling the lubricant in the compressor a heat exchanger is built into the system, taking up quite a large amount of space. This heat exchanger is then situated between the oil separating device and the lubricant injection point on the compressor.

SUMMARY OF THE INVENTION

The object of the invention is therefore to provide a compressor of the type mentioned above, in which optimum cooling of the lubricant is ensured, without the output and the operating reliability being adversely affected, while the size of the device required for the purpose can still remain limited. This is achieved through the fact that the device for cooling the lubricant comprises a cooling medium inlet opening out near or in the delivery port.

The compressed mixture leaving the compressor via the delivery port has a high degree of turbulence. Since the cooling medium is injected precisely at this point, a thorough mixing of the mixture and the cooling medium is obtained in a short time and over a short distance. This ensures a rapid and reliable cooling of the mixture through the evaporating cooling medium. This is necessary to prevent cooling medium from being discharged in the liquid state into the oil separating device, with the risk of liquid cooling medium being fed to the compressor instead of lubricant, for example at the position of the bearings.

The cooling of the compressed mixture could also take place through injection of cooling medium liquid at a point downstream of the delivery port. The turbulence will, however, in that case be much less strong, which is less advantageous for rapid cooling.

In the known device for cooling the compressed mixture the cooling action can be improved by generating turbulence in, for example, the delivery pipe between compressor and oil separator. This is, however, accompanied in most cases by a fall in pressure, which adversely affects output.

The invention can be used for any type of rotary compressor. Beneficial results can be obtained in particular in this respect in the case of a twin-screw compressor which is provided with a compressor stator with a gastight outer shell and an inner double cylindrical housing, in which the housing has at least one bore opening out in or near the delivery port.

The cooling medium can be fed to the bore by means of a pipe which opens out with one end on the outside of the shell, and is connected at the other end to the bore.

Since the shell and the housing of the compressor reach a different temperature during operation, expansion differences will occur between them. The cooling medium inlet therefore preferably has a flexible part between shell and housing for absorbing said expansion differences.

Particularly good results are obtained if the housing has three bores which are distributed regularly at an angle of essentially 90° over the half of the housing facing away from the delivery aperture opening out laterally on the housing. These three bores mean, on the one hand, that sufficient cooling medium can be fed in while, on the other, the diameter of the bores can remain limited. This is important for maintaining the mechanical strength of the housing at a sufficiently high level.

Each bore preferably runs in a plane at right angles to the axis of rotation of the compressor elements. This ensures that the injected cooling medium does not go between said compressor elements, which would adversely affect their operation.

BRIEF DESCRIPTION OF THE DRAWINGS

The invention will be explained in greater detail below with reference to an example of an embodiment shown in the figures.

DETAILED DESCRIPTION OF THE INVENTION

Figure 1:
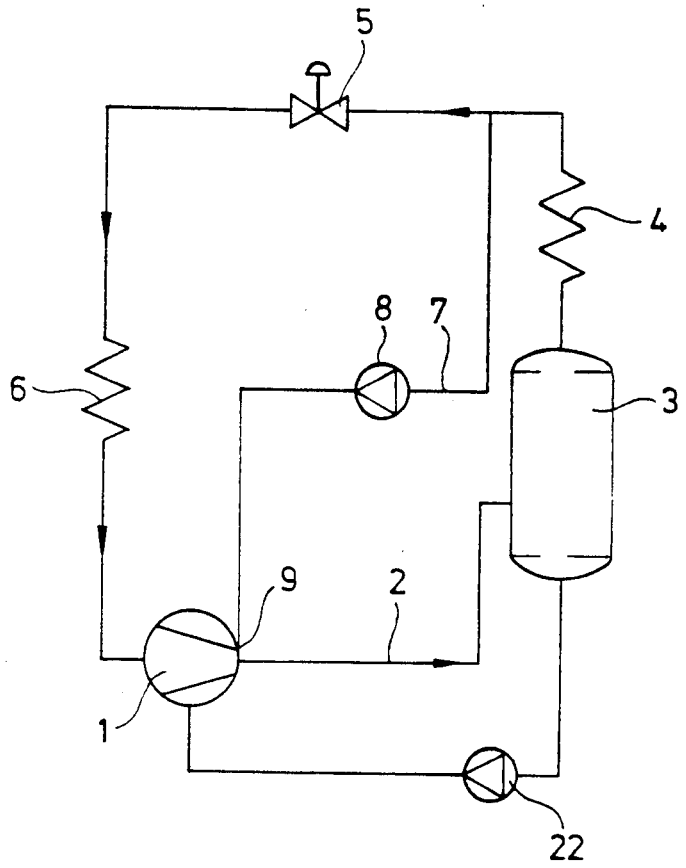
FIG. 1 shows a circuit diagram of a cooling plant containing a screw compressor according to the invention.

In the diagram shown in FIG. 1 the screw compressor according to the invention is indicated by 1. The cooling medium is compressed by means of this screw compressor 1. The cooling medium mixed with lubricant passes through the delivery pipe 2 into the oil separating device 3, in which the lubricant is separated from the gaseous, compressed cooling medium. The cooling medium then flows through the condenser 4, in which condensation occurs, following which expansion takes place at 5. Finally, vaporisation occurs in the cooling element 6, with the result that the desired cooling effect is obtained. The vaporised, gaseous cooling medium then flows back to the screw compressor 1, following which the cycle described above is repeated.

According to the invention, the liquefied cooling medium is now injected through pipe 7 and pump 8 in or near the delivery port 9 of the screw compressor 1. A very good mixing of the cooling medium with the mixture supplied through the screw compressor 1, composed of compressed cooling medium and oil, is obtained as a result. The cooling liquified medium vaporising in the delivery port 9 and fed in through pipe 7 can consequently exert an excellent cooling influence on the mixture compressed by the screw compressor 1, with the result that already after a length of pipe 2 of one meter the oil has reached the desired temperature. Oil can be fed to the oil injection points and the bearings of the compressor by means of oil pump 22.

Figure 2:
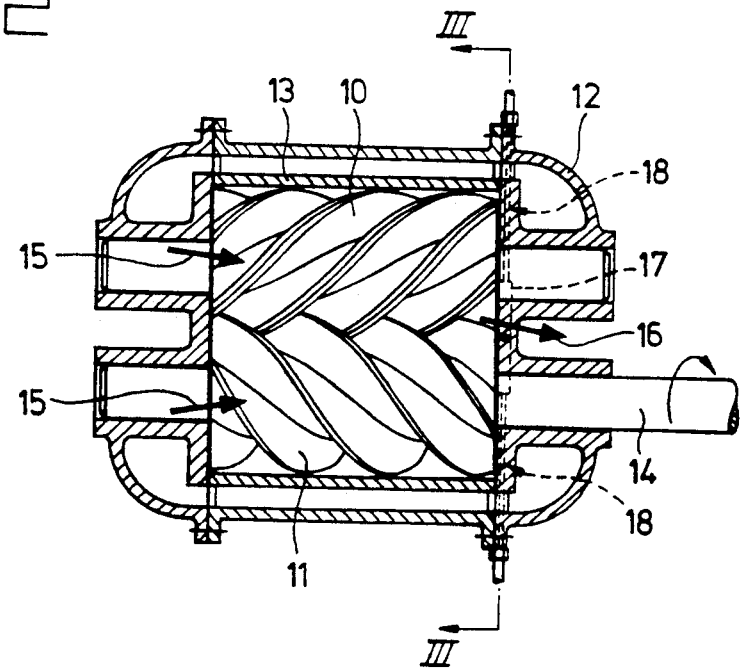
FIG. 2 shows a top view, partially in section, of the housing of a twin-screw compressor.

FIG. 2 shows a cross-section through a twin-screw compressor, at the level of the compression elements 10, 11 in the form of screws. The screw compressor has an outer shell 12 and an inner double cylindrical housing 13, which are rigidly connected to each other. The screws 10 and 11 are supported in the known manner and are also driven in the known manner by shaft 14. The arrows 15 indicate the infeed of the medium to be compressed, and the arrow 16 indicates the discharge. Of course, the medium to be compressed is sucked in through the suction port and is discharged from the screw compressor through the delivery port, which is shown schematically at 17. As further shown in FIG. 2, feed elements 18 open out in this delivery port 17, through which elements a cooling liquified medium for cooling the compressed mixture coming out of the screw compressor and also containing oil is fed in.

Figure 3:
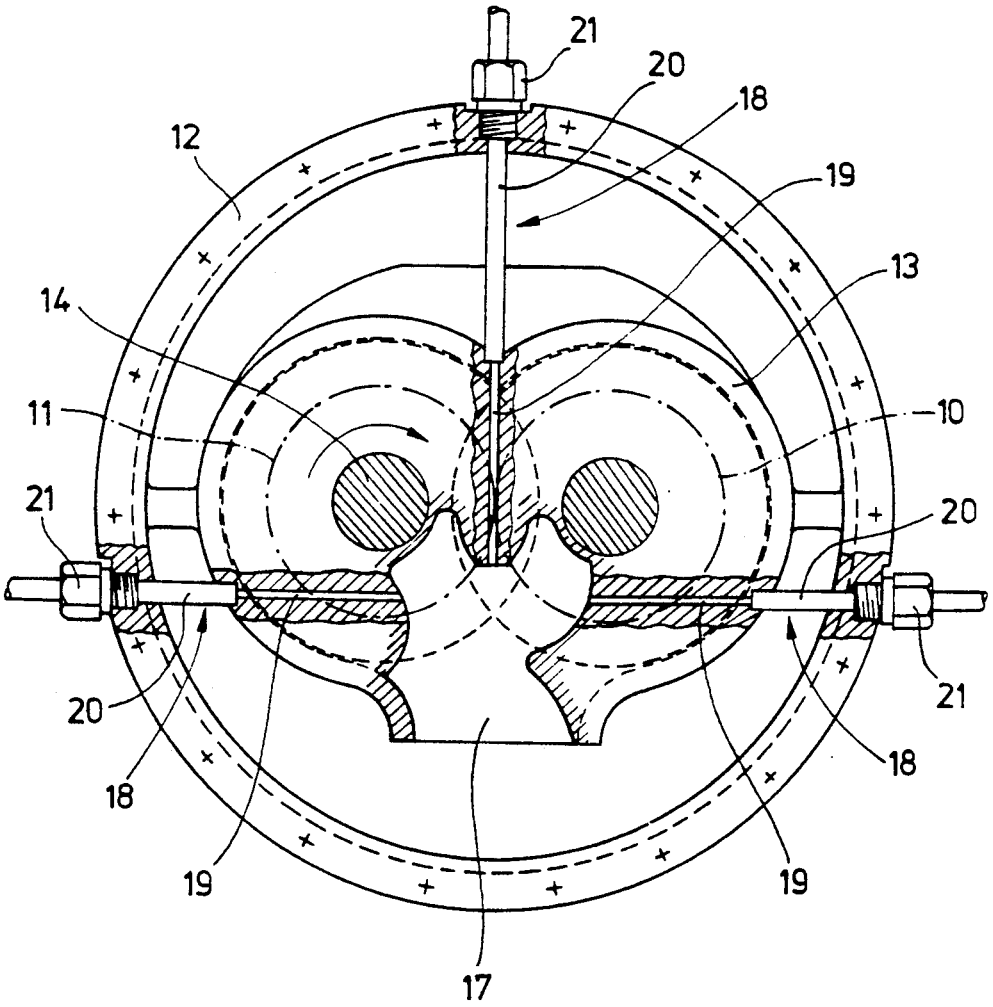
FIG. 3 shows a cross-section III—III according to FIG. 2.

FIG. 3 shows more clearly how these elements 18 are fitted. Bores 19 are first provided for the purpose in the double cylindrical housing 13, which bores open out into the delivery port 17 at one side and onto the outside of said double cylindrical housing at the other side. A pipe 20 is connected there to each bore, said pipe opening out via a screw coupling 21 onto the outside of the outer shell 12 of the screw compressor.

The cooling liquified medium can be injected by means of the feed elements 18 into the delivery port, where the compressed mixture, which also contains oil, is in a very turbulent state. This means that the cooling liquified medium is directly mixed with that mixture, with the result that a good heat exchange is obtained.

The pipes 20 can be flexible, in order to ensure that expansion differences between the outer shell 12 and the double cylindrical housing 13 cannot lead to breakage.

I claim:

1. Rotary compressor comprising a compressor stator and one or more rotary compression element, said compressor stator having an end wall, a suction port, a delivery port situated in said stator end wall, and a lubricant inlet, the lubricant being intended for lubricating each compression element, for sealing the gaps between the individual compression elements and between the compression elements and the compression stator, and for cooling the medium to be compressed during a compression process, a device for cooling the lubricant by injecting a cooling medium, said device for cooling the lubricant having a cooling medium inlet contained in the compressor stator end wall and running in a plane at right angles to the axis of rotation of the compressor elements in such a way that the cooling medium inlet opens out laterally in the delivery port next to an end face of each compressor element which faces said stator end wall.

2. Rotary compressor according to claim 1, wherein said compressor stator includes a gas-tight outer shell and an inner double cylindrical housing having a housing end wall, said housing end wall having at least one bore opening out in the delivery port.

3. Rotary compressor according to claim 2, wherein the outer shell has at least one pipe opening out on its outside and connected to the bore.

4. Rotary compressor according to claim 3, wherein the cooling medium inlet has a flexible part between the outer shell and the housing for absorbing expansion differences.

5. Rotary compressor comprising a compressor stator and one or more rotary compression element, said compressor stator including a gas-tight outer shell and an inner double cylindrical housing having an end wall, a suction port, a delivery port situated in said end wall, and a lubricant inlet, the lubricant being intended for lubricating each compression element, for sealing the gaps between the individual compression elements and between the compression elements and the compression stator, and for cooling the medium to be compressed during a compression process, said housing having three bores opening out in the delivery port for feeding a cooling medium for cooling the lubricant, said three bores being distributed regularly at an angle of essentially 90° over half of the housing end wall facing away from the delivery port opening out laterally in the housing end wall.

* * * * *